US008151895B1

(12) United States Patent
Kunz

(10) Patent No.: US 8,151,895 B1
(45) Date of Patent: Apr. 10, 2012

(54) EUTECTIC SALT INFLATED WELLBORE TUBULAR PATCH

(75) Inventor: Dale Ian Kunz, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/152,628

(22) Filed: Jun. 3, 2011

Related U.S. Application Data

(63) Continuation-in-part of application No. 12/714,282, filed on Feb. 26, 2010, now Pat. No. 7,997,337, which is a continuation of application No. 11/676,191, filed on Feb. 16, 2007, now Pat. No. 7,673,692.

(60) Provisional application No. 60/774,688, filed on Feb. 17, 2006.

(51) Int. Cl.
*E21B 33/12* (2006.01)

(52) U.S. Cl. ..... 166/387; 166/122; 166/187; 166/277

(58) Field of Classification Search ..... 166/387, 166/122, 187, 277
See application file for complete search history.

(56) References Cited

U.S. PATENT DOCUMENTS

| | | | | |
|---|---|---|---|---|
| 3,314,479 | A | 4/1967 | McCullough et al. | 166/63 |
| 4,573,537 | A | 3/1986 | Hirasuna et al. | 166/387 |
| 4,923,007 | A | 5/1990 | Sanford et al. | 166/187 |
| 5,819,846 | A | 10/1998 | Bolt et al. | 166/123 |
| 5,829,524 | A | 11/1998 | Flanders et al. | 166/277 |
| 5,833,001 | A | 11/1998 | Song et al. | 166/287 |
| 6,474,414 | B1 | 11/2002 | Gonzalez et al. | 166/277 |
| 7,234,533 | B2 | 6/2007 | Gambier | 166/387 |
| 7,290,609 | B2 | 11/2007 | Wardlaw et al. | 166/277 |
| 7,455,104 | B2 * | 11/2008 | Duhon et al. | 166/57 |
| 7,673,692 | B2 | 3/2010 | Kunz | 166/387 |
| 2002/0056553 | A1 | 5/2002 | Duhon et al. | 166/302 |
| 2007/0051514 | A1 | 3/2007 | La Rovere | 166/277 |
| 2007/0199693 | A1 * | 8/2007 | Kunz | 166/179 |
| 2010/0018694 | A1 * | 1/2010 | Kunz | 166/179 |

* cited by examiner

*Primary Examiner* — Daniel P Stephenson
*Assistant Examiner* — Yong-Suk Ro
(74) *Attorney, Agent, or Firm* — Shawn Hunter

(57) ABSTRACT

Systems and methods for patching a desired section of wellbore casing or another tubular member. A patch assembly is provided which includes a tubular patch sub which is radially surrounded by an inflatable boot. A setting tool is used to set the patch assembly within the casing. The setting tool includes a heated barrel that contains eutectic material in liquid form. When actuated from the surface, eutectic material is flowed from the setting tool to the boot of the patch assembly. The eutectic material inflates the boot to secure the patch sub at a desired location within the wellbore.

18 Claims, 7 Drawing Sheets

EUTECTIC SALT INFLATED WELLBORE TUBULAR PATCH

This application is a continuation-in-part of U.S. patent application Ser. No. 12/714,282 filed on Feb. 26, 2010 now U.S. Pat. No. 7,997,337, which was a continuation of U.S. patent application Ser. No. 11/676,191 filed on Feb. 16, 2007, now U.S. Pat. No. 7,673,692, which claimed priority to provisional patent application Ser. No. 60/774,688 filed on Feb. 17, 2006.

BACKGROUND OF THE INVENTION

1. Field of the Invention

The invention relates generally to arrangements used to patch breaches in wellbore casings or liners.

2. Description of the Related Art

During the lifetime of a well, points of weakness and sometimes actual breaches occur in the metallic casing which lines the wellbore. This problem can occur with wellbore liners and other tubular members used in the downhole environment. Patch assemblies are known which include a patch sub and multiple packers which are set between the patch sub and the damaged casing to retain the patch sub in place over the breach or point of weakness. Unfortunately, the mechanical components of the packers require space, which necessitates the use of a patch sub of greatly reduced diameter. This results in a loss of useable wellbore area.

SUMMARY OF THE INVENTION

The present invention provides systems and methods for patching a desired section of wellbore casing or another tubular member. In a described embodiment, a patch assembly is provided which includes a tubular patch sub which is radially surrounded by an inflatable boot. The boot is preferably formed of a high-temperature tolerant material, such as silicone-coated KEVLAR® fiber, which is sufficient to contain high-temperature eutectic material in liquid form.

A setting tool is used to set the patch assembly within the casing. An exemplary setting tool includes a heated barrel that contains eutectic material in liquid form. When actuated from the surface, eutectic material is flowed from the setting tool to the boot of the casing patch assembly. The eutectic material inflates the boot to secure the patch sub at a desired location within the wellbore. Once in the boot, the eutectic material will cool and assume solid form.

After the patch assembly has been set, the setting tool is separated from the patch assembly and then removed from the wellbore. In a described embodiment, removal of the setting tool closes flow ports into the boot.

The use of a flexible boot and eutectic material permits patch assemblies to be employed which require very small spacing between the patch sub and the casing being patched.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein:

FIG. 1 is a side, cross-sectional view of an exemplary wellbore with a breached casing and having a patch assembly and setting tool being run in.

DETAILED DESCRIPTION OF THE PREFERRED EMBODIMENTS

Figure 1:
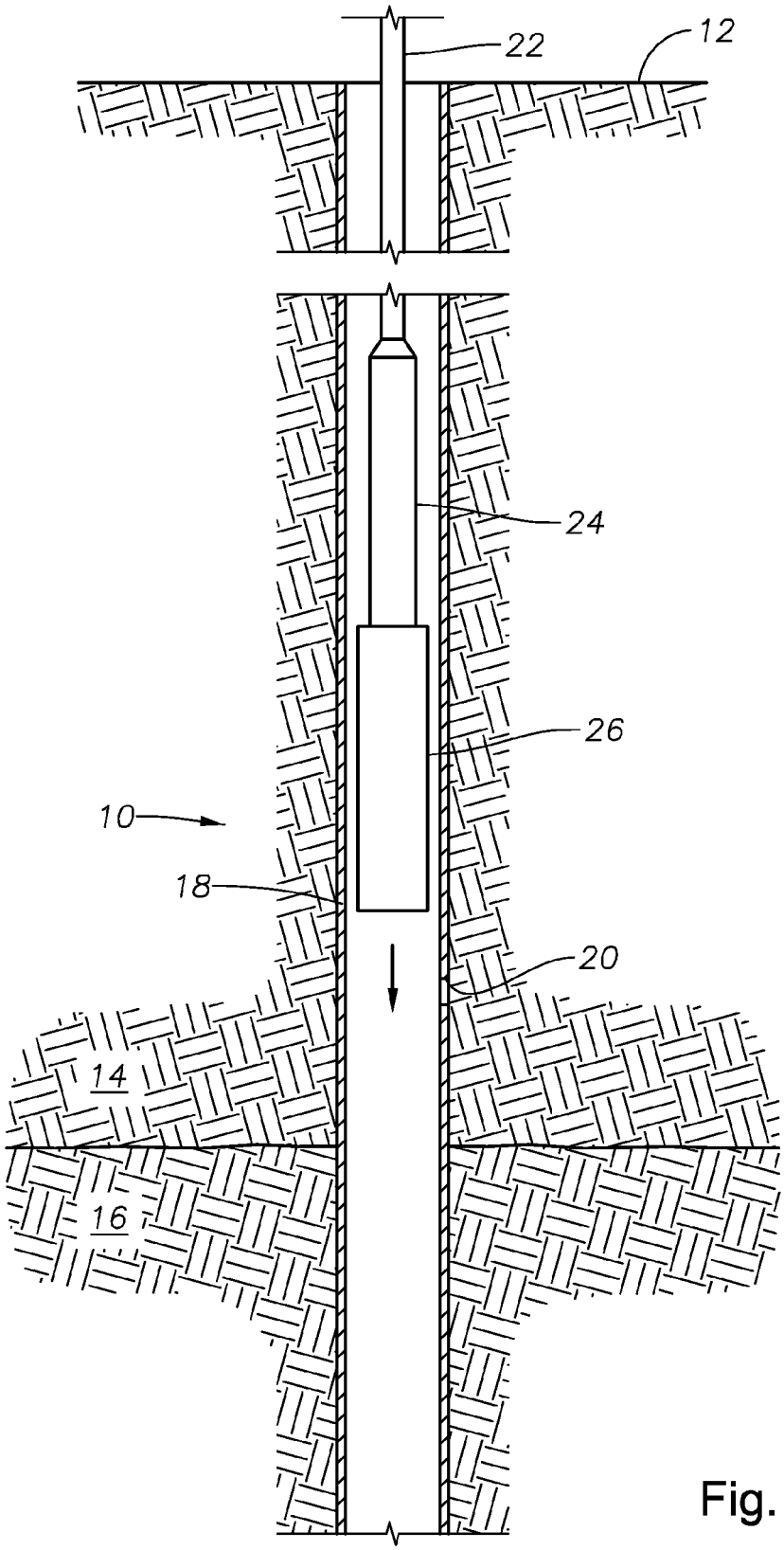

FIG. 1 depicts an exemplary wellbore 10 which has been drilled from the surface 12 through the earth 14 down to a hydrocarbon-bearing formation 16. The wellbore 10 has been lined with metallic casing 18 of a type known in the art. The casing 18 has a breach within it, depicted at 20, which it is desired to patch. The term "breach", as used herein, need not require an actual opening within the casing 18, but may also refer to an area of weakness which it is desired to patch.

A wireline, e-line, or similar running string 22 is disposed into the wellbore 10 from the surface 12. A setting tool 24 is secured to the running string 22 and is releasably secured to a patch assembly 26 which is constructed in accordance with the present invention.

Figure 2:
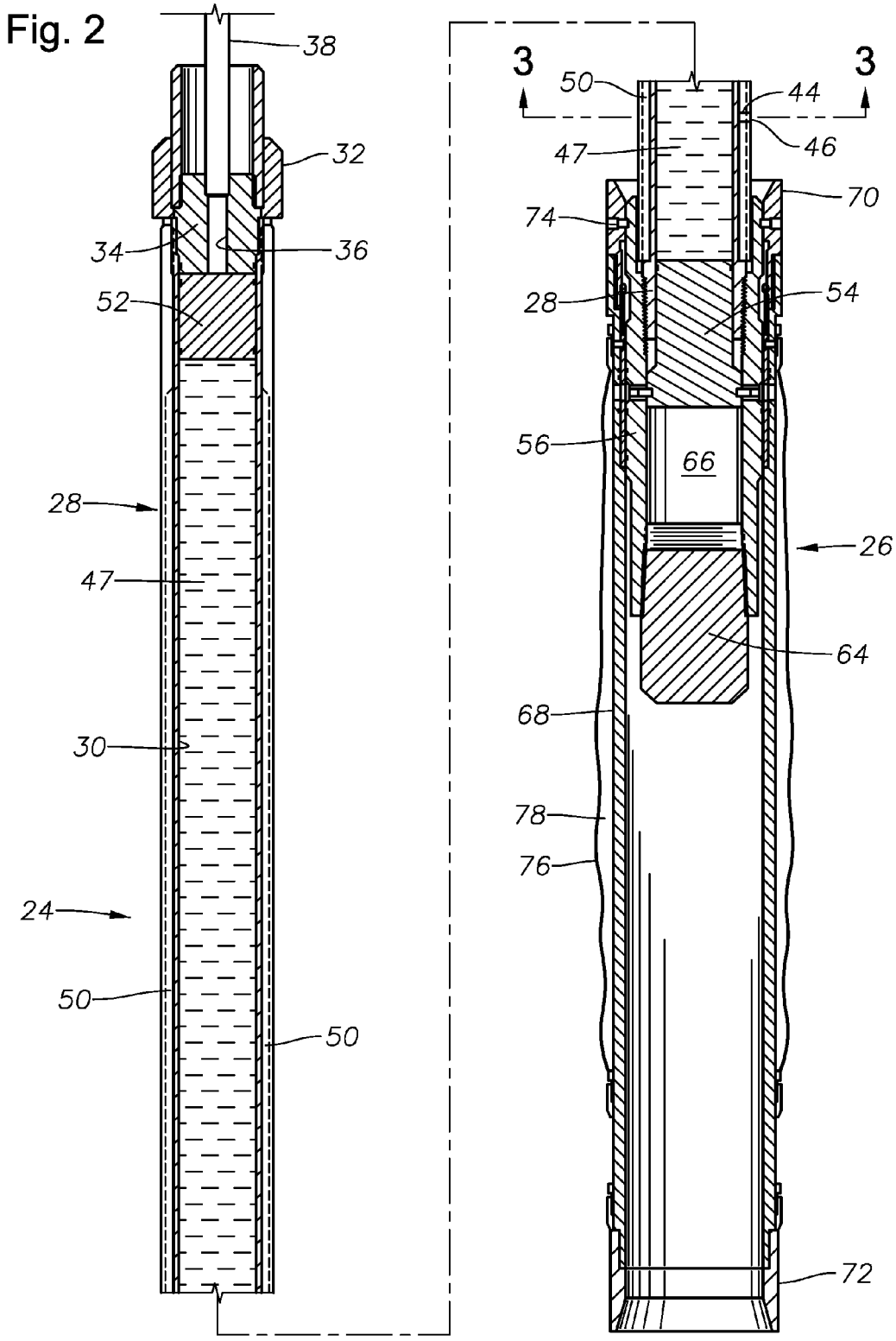
FIG. 2 is an enlarged side, cross-sectional view of the patch assembly and setting tool shown in FIG. 1 in a run-in configuration.
Figure 3:
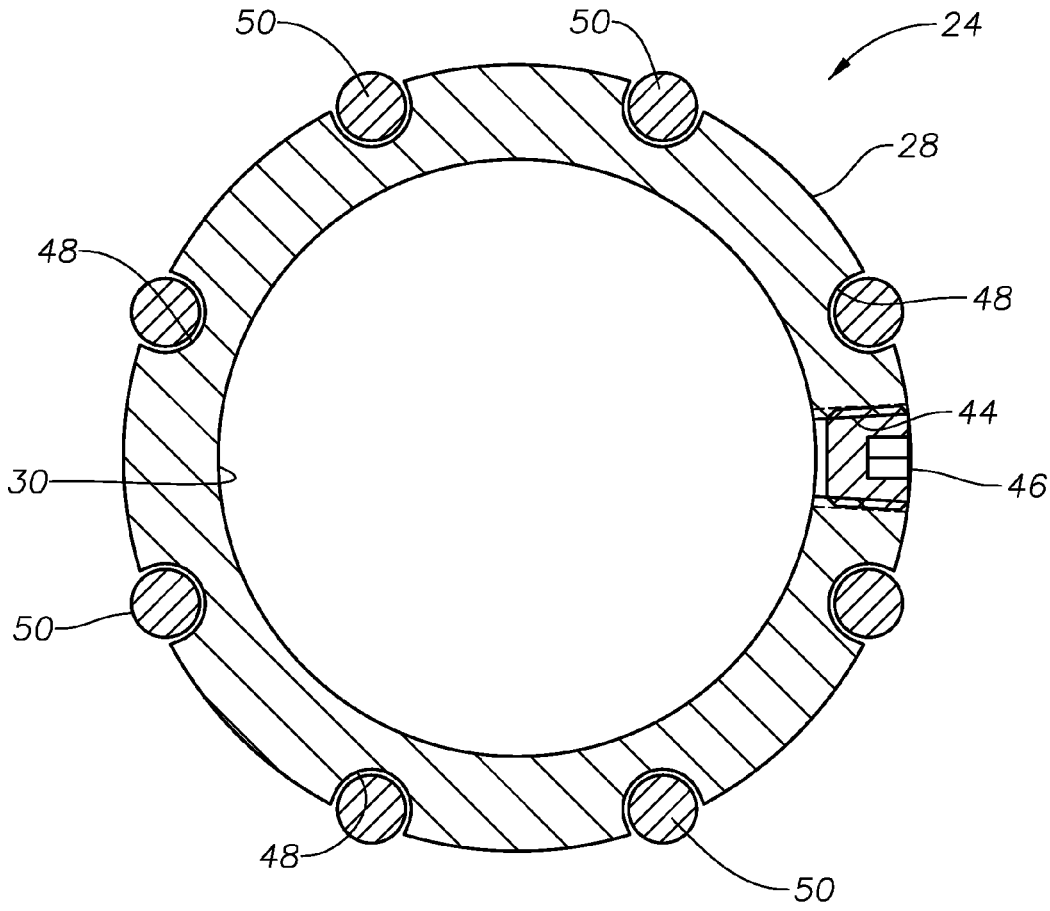
FIG. 3 is an axial cross-section taken along lines 3-3 in FIG. 2.

The setting tool 24, which is better appreciated with reference to FIGS. 2 and 3, includes an elongated heating barrel 28 which defines an interior chamber 30. The upper axial end of the heating barrel 28 is affixed to a top sub 32. Above the top sub 32 is an arrangement (not shown) known in the art by which the setting tool 24 is secured to the running string 22. A top plug 34 is threadedly secured within the top sub 32. A flow port 36 is formed through the top plug 34 and is in fluid communication with fluid injection conduit 38. The fluid injection conduit 38 extends from the setting tool 24 to a fluid supply which may be in the form of a high-pressure cylinder (not shown) which is attached to the setting tool 24 having an electrically-operated valve which can be opened from the surface 12. Cylinders and valves of this type are well known in the art. Other suitable fluid supply arrangements known in the art may be used as well. In a current embodiment, the fluid provided by the fluid supply is nitrogen. A fill port 44 is disposed through the heating barrel 28 and is closed off by removable plug 46.

Eutectic material 47 is located within the chamber 30 of the heating barrel 28, and may be flowed into the chamber 30 in its liquid state via the fill port 44. In one embodiment, the eutectic material comprises eutectic salts. Eutectic salts are sometimes referred to as "phase changing salts" or phase-changing material. Eutectic materials are characterized by forming very regular crystalline molecular lattices in the solid phase. Eutectic materials are chemical compounds that have the physical characteristic of changing phase (melting or solidifying) at varying temperatures: melting at one temperature and solidifying at another. The temperature range between which the melting or solidification occurs is dependent on the composition of the eutectic material. When two or more of these materials are combined, the eutectic melting point is lower than the melting temperature of any of the composite compounds. The composite material is approximately twice as dense as water, weighing approximately 120 pounds per cubic foot. Salt-based eutectic material can be formulated to work at temperatures as low as 30° F. and as high as 1100° F. Metal-based eutectic materials can operate at temperatures exceeding 1900° F.

In a current embodiment, the salt compound is a sodium nitrate and potassium nitrate mixture which melts at approximately 610° F. and solidifies at approximately 500° F. The liquid salt compound exists as a superheated fluid, and when it changes phase, it does so very rapidly, typically in just minutes. When solidified, the salt compound has a compressive strength of approximately 2700 psi.

A number of axial grooves 48 are formed in the outer radial surface of the heating barrel 28, and heating elements 50 are disposed within the grooves 48. The heating elements 50 are preferably shaped to reside within the grooves 48 and are preferably supplied with electric power for heating via wires (not shown) that are incorporated into the running string 22. The heating element 50 may be energized to heat the barrel 28 to a temperature that is sufficient to maintain the eutectic material 47 in its liquid state.

The volume of eutectic material 47 within the barrel 28 is bounded at its upper end by a floating piston 52 and at its lower end by a lower piston 54. The floating piston 52 is slidably moveable within the chamber 30 and, when the chamber 30 is filled with eutectic material 47, the floating piston 52 is proximate to or in abutting contact with the top plug 34.

Figure 4:
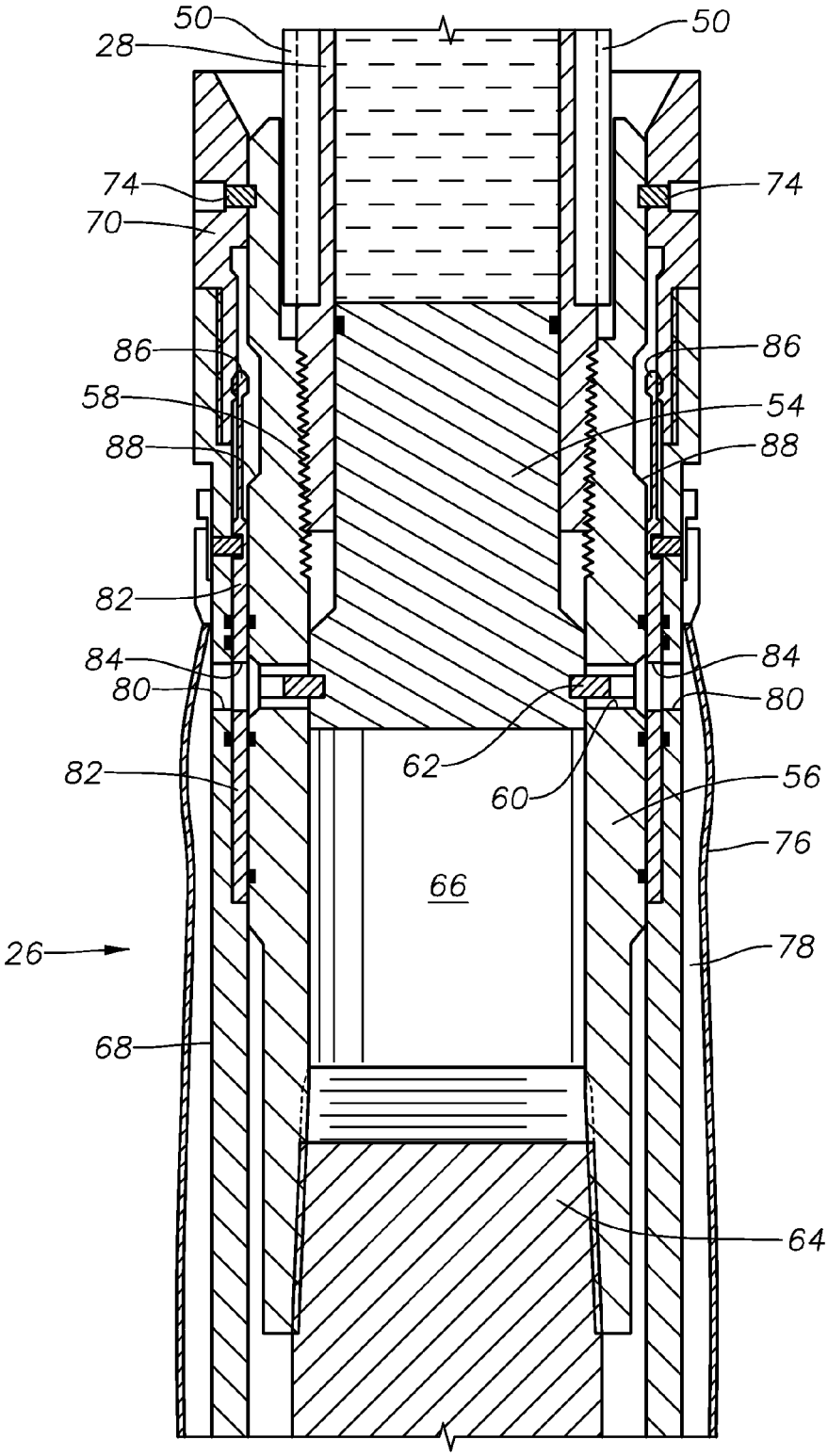
FIG. 4 is a side, cross-sectional view of the patch assembly and setting tool shown in FIG. 2, prior to the patch assembly being set.

The lower piston 54 is located radially within the lower end of the barrel 28 and a fill mandrel 56, as best shown in FIG. 4. The fill mandrel 56 is affixed to the lower end of the heating barrel 28 by threading 58. Fluid flow ports 60 are disposed through the fill mandrel 56 and are initially closed off by the lower piston 54, which is retained in place by frangible shear pins 62. A bottom plug 64 is threaded into the lower end of the fill mandrel 56 and represents the lower end of the setting tool 28. A collapsible chamber 66 is defined between the lower piston 54 and the bottom plug 64.

The patch assembly 26 includes a tubular patch sub 68 which preferably has a top sub 70 affixed to its upper end and a bottom sub 72 affixed to its lower end. Shear members 74 releasably affix the top sub 70 to the fill mandrel 56, thereby releasably securing the patch assembly 26 to the setting tool 24. An annular, flexible boot 76 radially surrounds the patch sub 68, and a cavity 78 is defined between the patch sub 68 and the boot 76. The boot 76 is preferably formed of a high-temperature tolerant material that is capable of containing the eutectic material 47 in its liquid, high-temperature state. In a current embodiment, the boot 76 is formed of silicone-coated KEVLAR® fiber. The boot 76 is secured to the sub 68 at its upper and lower axial ends so that the cavity 78 is completely enclosed.

Flow ports 80 (FIG. 4) are disposed through the patch sub 68 and are aligned with the flow ports 60 of the fill mandrel 56 when the casing patch assembly 26 is affixed to the setting tool 24. A slidable sleeve 82 is located within the upper end of the patch sub 68 and is moveable between a lower position, shown in FIG. 4, and an upper position, shown in FIG. 6. Openings 84 are disposed through the sleeve 82 and, when the sleeve 82 is in the lower position, these openings 84 are aligned with the flow ports 60 and 80. Collets 86 extend axially upwardly from the sleeve 82 and are shaped and sized to engage a complimentary shoulder 88 that is formed on the outer radial surface of the fill mandrel 56.

Figure 5:
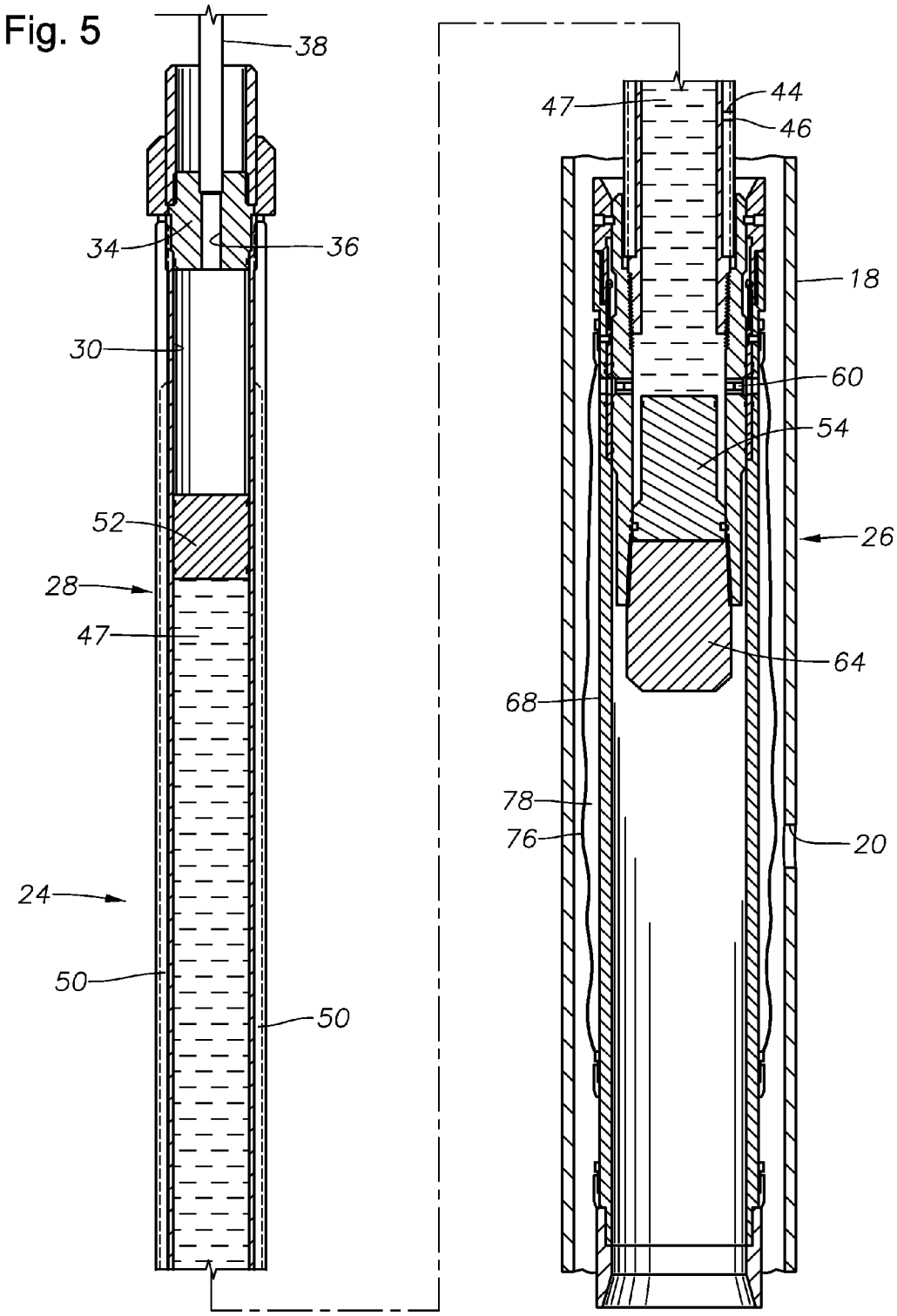
FIG. 5 is a side, cross-sectional view of the patch assembly and setting tool shown in FIGS. 2 and 4, during setting of the patch assembly.
Figure 6:
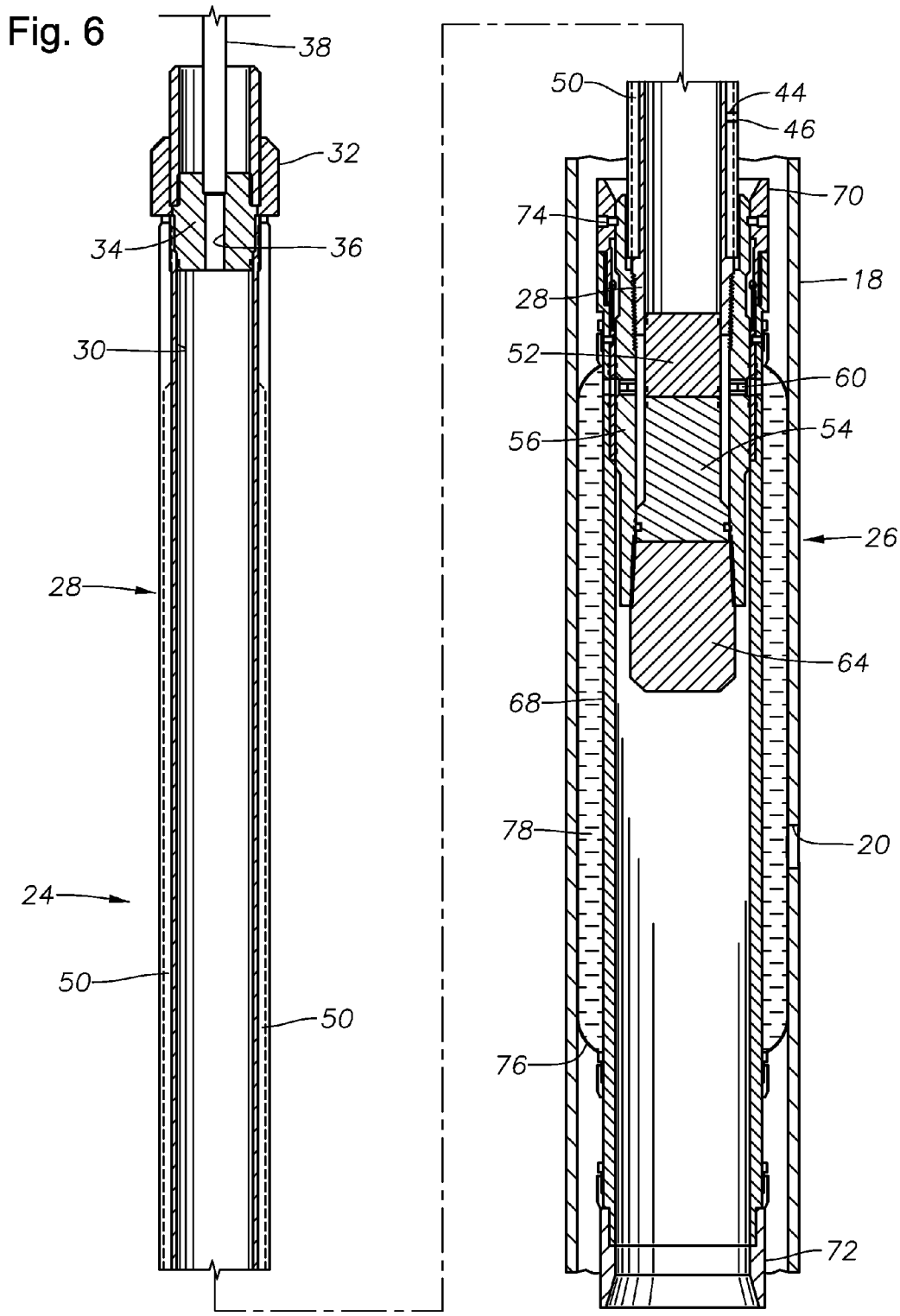
FIG. 6 is a side, cross-sectional view of the patch assembly and setting tool shown in FIGS. 2, 4 and 5, now with the patch assembly fully set in place.

In operation, the patch assembly 26 and setting tool 24 are lowered into the wellbore 10 by the running string 22 until the patch assembly 26 is positioned adjacent the breach 20. At this point, fluid is flowed into the setting tool 24 via the fluid conduit 28. The fluid flows through the flow port 36 of the top sub 34 and urges the floating piston 36 axially downwardly within the chamber 30 of the heating barrel 28. The lower piston 54 will be urged downwardly as a result of fluid pressure within the barrel 28, shearing frangible pins 62 and uncovering ports 60. The liquid eutectic material 47 that fills the chamber 36 of the heating barrel 28 can now flow through aligned ports and openings, 60, 84 and 80 to enter the cavity 78 within the boot 76. FIG. 5 illustrates the setting tool 24 in an intermediate condition wherein the floating piston 54 has been moved partially downward within the chamber 30, and the lower piston 54 having been moved downwardly, collapsing chamber 66, so as to be adjacent the bottom plug 64. As fluid flows into the cavity 78, it will begin to fill the cavity 78 and expand the boot 76. As the boot 76 expands, it secures the patch sub 68 and top and bottom subs 70, 72 in place within the casing 18. FIG. 6 illustrates a further point in the setting process wherein the liquid eutectic material 47 has been flowed out of the chamber 30 and into the boot 76. The floating piston 52 has descended within the chamber 30 until it comes into contact with the lower piston 54. After the liquid eutectic material 47 has been flowed out of the heating barrel 28 and into the boot 76, the material 47 will cool and solidify.

Figure 7:
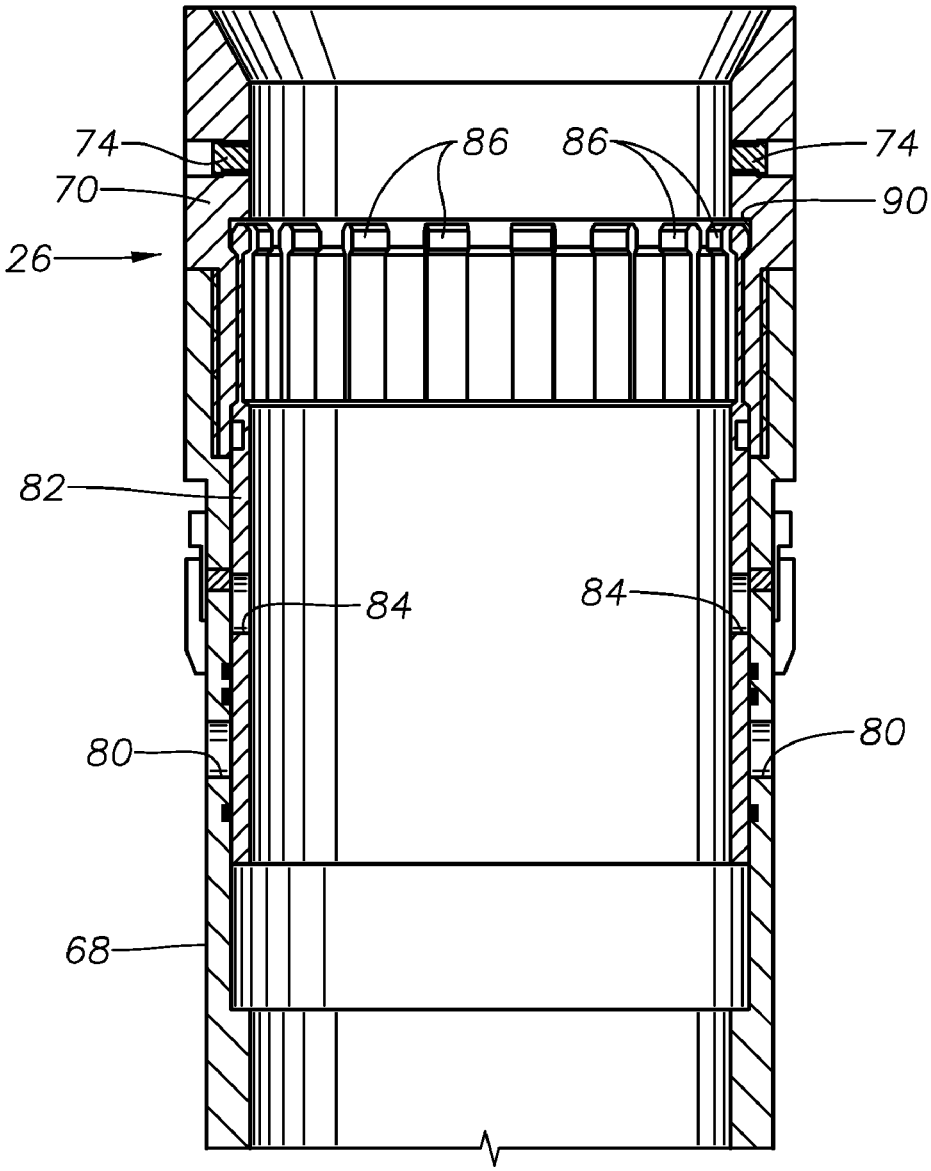
FIG. 7 is an enlarged side, cross-sectional view of portions of the patch assembly following removal of the setting tool.

Once the patch assembly 26 has been set, the setting tool 24 is separated from the patch assembly 26 by pulling upwardly on the running string 22 to shear the shear members 74. As the setting tool 24 is moved upwardly through the wellbore 10 by the running string 22, the shoulder 88 of the fill mandrel 56 will contact and engage the inwardly protruding portions of the collets 86 on the slidable sleeve 82. Due to this engagement, further upward movement of the setting tool 24 will move the slidable sleeve 82 from its lower position to its upper position. FIG. 7 shows details of the upper end of the casing patch assembly 26 after it has been set and the setting tool 24 has been removed. As can be seen in FIG. 7, the openings 84 in the sleeve 82 are moved above the ports 80 in the patch sub 68, thereby closing the ports 80 against fluid flow therethrough. As the sleeve 82 reaches its upper position, the outwardly protruding portions of the collets 86 will retract into an annular recess 90 that is formed on the interior radial surface of the top sub 70. This will release the engagement between the collets 86 and shoulder 88, allowing the setting tool 24 to be completely freed from the casing patch assembly 26.

The invention provides systems for patching a desired section of wellbore casing or another wellbore tubular member. An exemplary patching system includes a patch assembly 26 and a setting tool 24. The exemplary patch assembly 26 includes a tubular patch sub 68 and a flexible boot 76 which radially surrounds the patch sub 68 to form a cavity 78 therein. The exemplary setting tool includes a heating barrel 28 which contains eutectic material at a temperature sufficient to maintain the eutectic material 47 in a liquid state. In addition, a flow mechanism is provided to selectively flow eutectic material from the heating barrel 28 to the cavity 78 of the patch assembly 26. In a described embodiment, the flow mechanism is provided by a flow path (aligned flow ports 60, 84, 80) through which the liquid eutectic material can flow from the heating barrel 28 to the boot 76. In particular embodiments, the flow mechanism includes a piston, such as floating piston 52, which is moveable within the chamber 36 of the heating barrel 28 to urge the eutectic material 47 out of the chamber 36 and into the boot 76.

Those of skill in the art will also understand that the invention provides methods for patching a desired section of a wellbore tubular. According to exemplary methods, a patch assembly 26 and setting tool 24 are disposed into a wellbore 10 until the patch assembly is located adjacent a section of tubular that it is desired to patch. The patch assembly 26 is then set by flowing liquid eutectic material along a flow path from the setting tool 24 to the cavity 78. The eutectic material will then cool within the cavity 78 and solidify. The setting tool 24 is detached from the patch assembly 26 and removed from the wellbore 10. In a further exemplary embodiment, the flow path is closed against fluid flow as the setting tool 24 is detached and removed.

The use of a flexible, fabric boot 76 and liquid eutectic material 47 permits patch assemblies to be employed which require very small spacing between the patch sub 68 and the casing being patched.

Those of skill in the art will recognize that numerous modifications and changes may be made to the exemplary designs and embodiments described herein. The invention is limited only by the claims that follow and any equivalents thereof.

What is claimed is:

1. A patch assembly for patching a desired section of a wellbore tubular, the patch assembly comprising:

a patch sub;

a flexible boot radially surrounding the patch sub which is formed of a material suitable for retaining a liquid, eutectic material;

a cavity defined between the patch sub and boot to receive liquid, eutectic material; and a heating barrel associated with the patch sub to supply the liquid, eutectic material, the heating barrel having a heating element that is energized to heat the barrel to a temperature that is sufficient to maintain eutectic material within the heating barrel in a liquid state.

2. The patch assembly of claim 1 further comprising a eutectic material disposed within the cavity.

3. The patch assembly of claim 2 wherein the eutectic material comprises a eutectic salt compound.

4. The patch assembly of claim 3 wherein the eutectic salt compound comprises a sodium nitrate and potassium nitrate mixture.

5. The patch assembly of claim 1 wherein the boot is formed of silicone-coated KEVLAR® fiber.

6. A system for patching a desired section of a wellbore tubular, the system comprising:

a patch assembly comprising a tubular patch sub and a flexible boot radially surrounding the patch sub to define a cavity therebetween;

a setting tool for setting the patch assembly within the desired section, the setting tool comprising:

a heating barrel having a chamber containing a eutectic material and a heating element that is energized to heat the barrel to a temperature sufficient to maintain the eutectic material in a liquid state; and a flow mechanism to flow the eutectic material from the chamber to the cavity.

7. The system of claim 6 wherein the eutectic material comprises a eutectic salt compound.

8. The system of claim 7 wherein the eutectic salt compound comprises a sodium nitrate and potassium nitrate mixture.

9. The system of claim 6 wherein the flow mechanism comprises a flow path through which the eutectic material can flow.

10. The system of claim 9 wherein the flow mechanism further comprises a piston moveably disposed within the chamber to urge the eutectic material out of the chamber.

11. The system of claim 6 wherein the boot is formed of silicone-coated KEVLAR® fiber.

12. A method of patching a section of wellbore tubular comprising the steps of:

disposing a patch assembly and setting tool into a wellbore until the patch assembly is located adjacent a section of wellbore tubular that it is desired to patch, wherein:

the patch assembly comprises a tubular patch sub and a flexible boot radially surrounding the patch sub to define a cavity therebetween;

the setting tool comprises a barrel having a chamber containing a eutectic material, a heating element that is energizable to heat the barrel, and a flow mechanism to flow the eutectic material from the chamber to the cavity;

energizing the heating element to heat the barrel to a temperature sufficient to maintain the eutectic material in liquid form; and flowing the eutectic material from the barrel chamber to the cavity to set the patch sub within the wellbore tubular.

13. The method of claim 12 further comprising the step of detaching the setting tool from the patch assembly.

14. The method of claim 13 wherein the step of detaching the setting tool from the patch assembly comprises rupturing a frangible shear member.

15. The method of claim 13 further comprising the step of closing a flow path into the boot as the setting tool is detached.

16. The method of claim 15 wherein the flow path is closed by a sliding sleeve.

17. The method of claim 12 further comprising the step of cooling the eutectic material within the boot to cause it to solidify.

18. The method of claim 12 wherein the step of flowing the eutectic material from the barrel chamber to the cavity further comprises moving a piston axially through the chamber to urge the eutectic material out of the chamber.

* * * * *